US009870890B2

(12) United States Patent
Kumar et al.

(10) Patent No.: US 9,870,890 B2
(45) Date of Patent: Jan. 16, 2018

(54) LOAD CENTER WITH PLUG-IN NEUTRAL

(71) Applicant: General Electric Company, Schenectady, NY (US)

(72) Inventors: Rajeev Kumar, Telangana (IN); Poulomi Ghosh, Telangana (IN); Mahadeva Mallappa Mittu, Karnataka (IN); Bradley Eden Parlee, Maitland, FL (US); Jonathan David Potter, Southington, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 165 days.

(21) Appl. No.: 14/606,578

(22) Filed: Jan. 27, 2015

(65) Prior Publication Data

US 2016/0217957 A1 Jul. 28, 2016

(51) Int. Cl.

| | |
|---|---|
| ***H01H 71/08*** | (2006.01) |
| ***H01H 71/00*** | (2006.01) |
| *H01H 83/02* | (2006.01) |
| *H01H 83/20* | (2006.01) |

(52) U.S. Cl.

CPC ..... *H01H 71/002* (2013.01); *H01H 71/08* (2013.01); *H01H 83/02* (2013.01); *H01H 2083/201* (2013.01)

(58) Field of Classification Search

CPC ..... H02B 1/056; H02B 1/20; H01H 71/002; H01H 83/02; H01H 2083/201; H01H 71/08

See application file for complete search history.

(56) References Cited

U.S. PATENT DOCUMENTS

| | | | | |
|---|---|---|---|---|
| 4,004,197 | A | 1/1977 | Hawkes, Jr. | |
| 4,167,769 | A | 9/1979 | Luke et al. | |
| 5,082,355 | A * | 1/1992 | Warszawski | G02F 1/153 359/265 |
| 5,179,491 | A | 1/1993 | Runyan | |
| 5,825,598 | A | 10/1998 | Dickens et al. | |

(Continued)

FOREIGN PATENT DOCUMENTS

WO 2007125410 A2 11/2007

OTHER PUBLICATIONS

"Eaton's New Plug-In Circuit Breaker Panel Offers Weight Savings, Flexible Configurations, Enhanced Thermal Efficiency and Ease of Maintenance," Eaton Corporation; Aug. 2011; 2 pgs.

(Continued)

*Primary Examiner* — Zeev V Kitov
(74) *Attorney, Agent, or Firm* — GE Global Patent Operation; Stephen G. Midgley

(57) ABSTRACT

A load center includes an arc fault circuit interrupter comprising a plurality of contacts, an operating mechanism for separating the contacts, and an arc fault trip mechanism to generate a trip signal in the event of an arc fault detection. The load center also includes a neutral link electrically connected to the arc fault trip mechanism and the plurality of contacts. The load center further includes a mounting rail operatively coupled to the arc fault circuit interrupter, the arc fault circuit interrupter directly supported by the mounting rail. The load center yet further includes a neutral busbar and a plug-in neutral conductor electrically connecting the mounting rail to the neutral busbar.

9 Claims, 2 Drawing Sheets

(56) References Cited

U.S. PATENT DOCUMENTS

| | | | | |
|---|---|---|---|---|
| 5,946,179 | A * | 8/1999 | Fleege | G01R 31/025 361/42 |
| 7,508,653 | B2 | 3/2009 | Parlee | |
| 7,957,122 | B2 * | 6/2011 | Sharp | H02B 1/056 174/67 |
| 2008/0041612 | A1 * | 2/2008 | Negle | H05G 1/02 174/138 G |
| 2010/0328850 | A1 * | 12/2010 | Remmert | H02B 1/056 361/634 |
| 2012/0132506 | A1 | 5/2012 | Potratz | |
| 2013/0164961 | A1 | 6/2013 | Diaz et al. | |

OTHER PUBLICATIONS

"Plug-on Neutral Loadcenter," Eaton Corporation; Apr. 2009; 4 pgs.

* cited by examiner

LOAD CENTER WITH PLUG-IN NEUTRAL

BACKGROUND OF THE INVENTION

The subject matter disclosed herein relates to load centers and, more particularly, to arc fault circuit breakers for use with load centers.

Arc-fault interruption (AFI) and ground-fault interruption (GFI) circuit breakers traditionally require an extra conductor, often referred to as a "pigtail," to connect the circuit breaker to a neutral busbar of a load center with which the circuit breaker is used. Increased use of arc-fault circuit breakers in a residential load center results in additional pigtails in the wiring gutter of the load center, thereby presenting a smaller space within which to perform wiring operations.

For each circuit breaker added to a load center, the labor required to connect neutral lines is increased. Additionally, the small space between the back of the circuit breaker and the neutral bar can create an untidy installation based on bulky pigtails being overcrowded within the small space. Therefore, current methods of making neutral connections in circuit breakers are cumbersome and time consuming due to installation procedures that are required, thereby making these connections bulky and difficult to organize. Such procedures may include screwing and unscrewing the pigtail wires to the neutral bar, which are difficult procedures to perform in small spaces.

BRIEF DESCRIPTION OF THE INVENTION

According to one aspect of the invention, a load center includes an arc fault circuit interrupter comprising a plurality of contacts, an operating mechanism for separating the contacts, and an arc fault trip mechanism to generate a trip signal in the event of an arc fault detection. The load center also includes a neutral link electrically connected to the arc fault trip mechanism and the plurality of contacts. The load center further includes a mounting rail operatively coupled to the arc fault circuit interrupter, the arc fault circuit interrupter directly supported by the mounting rail. The load center yet further includes a neutral busbar and a plug-in neutral conductor electrically connecting the mounting rail to the neutral busbar.

According to another aspect of the invention, an arc fault circuit interrupter includes a plurality of contacts, an operating mechanism for separating the plurality of contacts, and an arc fault trip mechanism to generate a trip signal in the event of an arc fault detection. Also included is a neutral link electrically connected to the arc fault trip mechanism and operatively connectable to a neutral bus bar to form a neutral conduction path for the arc fault circuit interrupter.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
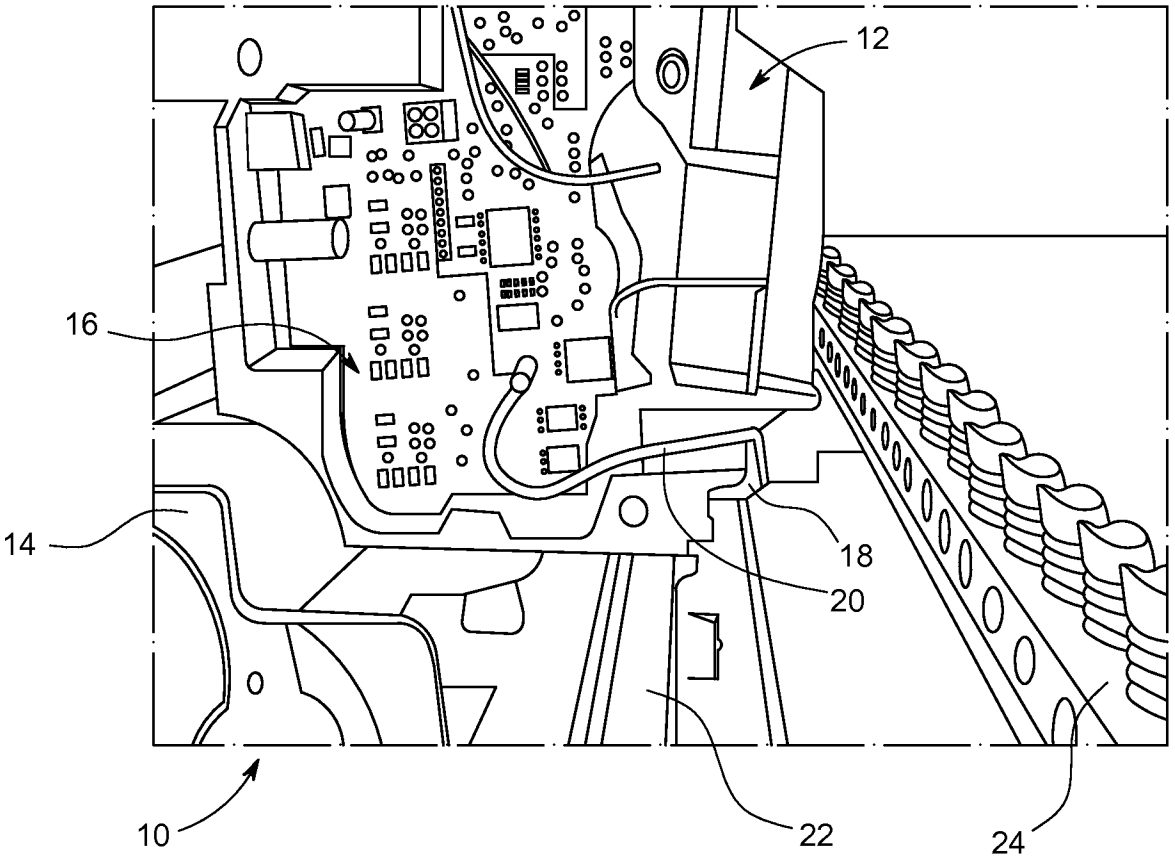
FIG. 1 is a partial cut-away view of a circuit breaker installed in a load center.
Figure 2:
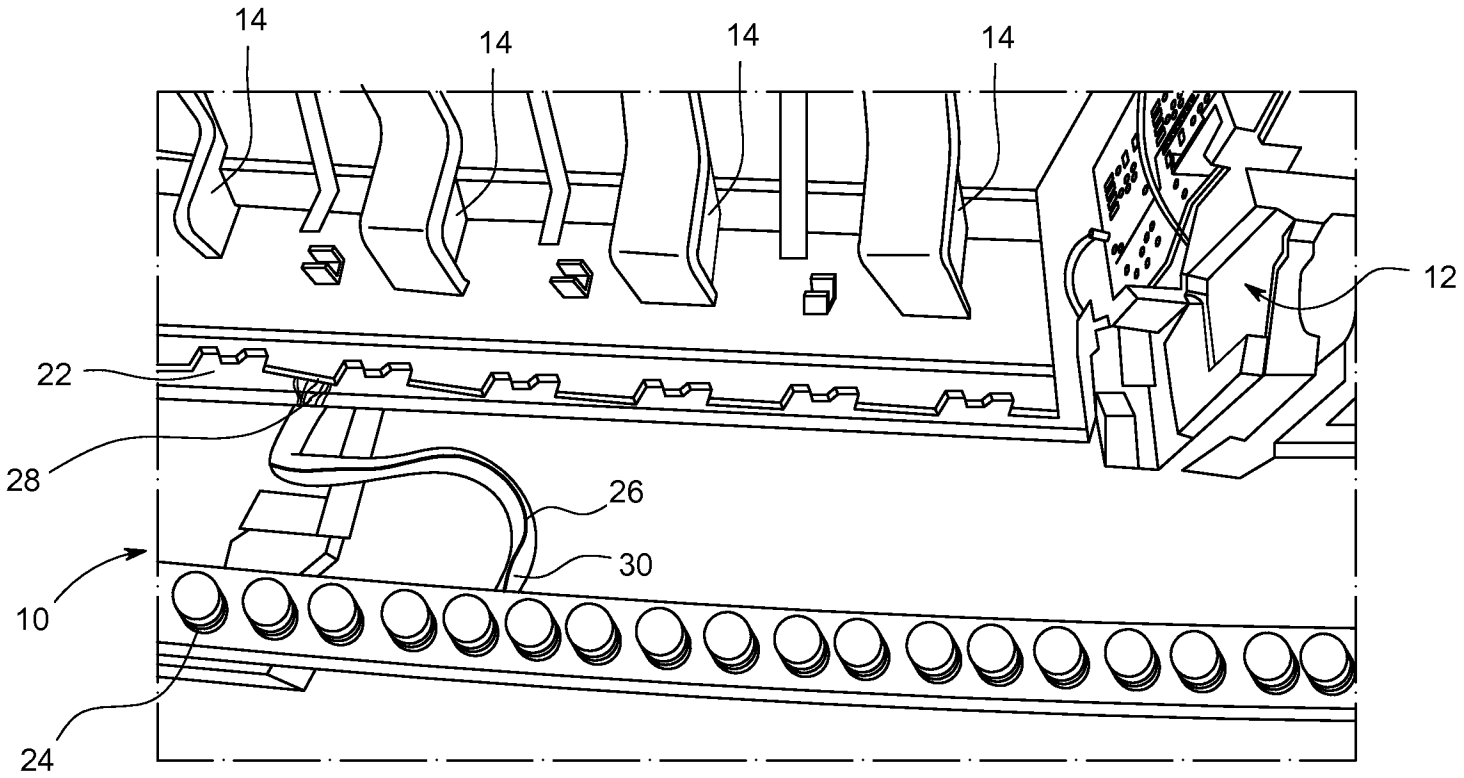
FIG. 2 is a perspective view of an electrical connection between the circuit breaker and a neutral busbar of the load center.

Referring to FIGS. 1 and 2, illustrated are an interior of an electrical distribution panel or load center 10 and a circuit breaker 12 installed therein, with portions of the circuit breaker 12 being shown in cut-away view. The load center 10 is typically employed in conjunction with a residential application, but it is to be appreciated that other working environments are contemplated. The illustrated circuit breaker 12 is an arc fault circuit interrupter, however, it is contemplated that other types of interrupters may benefit from the embodiments described herein. The load center 10 is arranged to receive side-by-side circuit breakers in two parallel rows in known arrangement. In a center section of the load center 10, a panel connector, such as those referenced with numeral 14 engage a corresponding conventional plug-on line jaw connector (not shown) of the circuit breaker 12 and connect the circuit breaker to line current.

An arc fault trip mechanism 16 configured to generate a trip signal in the event of arc fault detection is provided and an operating mechanism separates contacts of the circuit breaker 12, such as a contact arm 18. Electrically connecting the arc fault trip mechanism 16 and the contact arm 18 is a neutral link 20. In one embodiment, the neutral link 20 is an electrical conductor, such as an electrical wire, for example, with one end terminating at the mounting rail 22 and the other end terminating at the arc fault trip mechanism 16.

Along one side of an interior of the load center 10 are provided a mounting rail 22 and a neutral busbar 24, which are both made of conductive material(s). As shown in FIG. 1 and FIG. 2, the mounting rail has a top surface and a side surface, and the neutral busbar 24 includes a top surface and a side surface. The mounting rail 22 top surface directly or indirectly supports the circuit breaker 12, and is operatively coupled thereto upon installation of the circuit breaker 12 into the load center 10. In addition to providing structural support for the circuit breaker 12, the mounting rail 22 is a neutral path based on a connection with the neutral busbar 24. The mounting rail 22 and the neutral busbar 24 are electrically connected with a neutral conductor 26. Specifically, as shown in FIG. 2 the neutral conductor is disposed.

Along one side of an interior of the load center 10 are provided a mounting rail 22 and a neutral busbar 24, which are both made of conductive material(s). As shown if FIGS. 1 and 2, the mounting rail has a top surface and a side surface, and the neutral busbar 24 includes a top surface and a side surface. The mounting rail 22 top surface directly or indirectly supports the circuit breaker 12, and is operatively coupled thereto upon installation of the circuit breaker 12 into the load center 10. In addition to providing structural support for the circuit breaker 12, the mounting rail 22 is a neutral path based on a connection with the neutral busbar 24. The mounting rail 22 and the neutral busbar 24 are electrically connected with a neutral conductor 26.

The embodiments described above form a neutral path through the mounting rail 22. This allows the mounting rail 22 to efficiently provide dual functionality as a support structure for the circuit breaker 12 and as a neutral path based on its electrical connection to the neutral busbar 24.

This avoids the need for a pigtail connection that is often employed to establish the neutral path. The embodiments described herein reduce effort and cost associated with wiring installation relative to traditional assemblies.

Referring once more to FIG. 1, the neutral link 20 is described above in one example above as an electrical wire that is coupled to components to form an electrical conductor, but it is to be understood that the neutral link 20 may be an electrical conductor combined with another component. Overall, the embodiments described herein form an electrical conduction path that terminates at the neutral busbar 24, such that routing back to the circuit breaker 12 is not necessary.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A load center comprising:

an circuit interrupter having a plurality of contacts, an operating mechanism for separating the contacts, and an trip mechanism to generate a trip signal in the event of an electrical fault;

a neutral link electrically connected to the trip mechanism and the plurality of contacts;

a mounting rail operatively coupled to the circuit interrupter, the circuit interrupter directly supported by the top of the mounting rail;

a neutral busbar; and a plug-in neutral conductor electrically connecting the mounting rail to the neutral busbar; wherein the plug-in neutral conductor comprises a first end and a second end coupled to the side of the mounting rail and the side of the neutral busbar, respectively, and wherein the neutral conductor is disposed between the circuit interruptor and the neutral busbar.

2. The load center of claim 1, wherein the mounting rail provides a neutral conduction path for the circuit interrupter.

3. The load center of claim 1, wherein the neutral link comprises an electrical wire.

4. The load center of claim 1, wherein the neutral link, comprises a formed electrical conductor.

5. The load center of claim 1, wherein at least one of the first end and the second end is removably coupled thereto the mounting rail and the neutral busbar, respectively.

6. The load center of claim 1, wherein at least one of the first end and the second end is permanently coupled thereto the mounting rail and the neutral busbar, respectively.

7. The load center of claim 1, wherein the respective couplings to the mounting rail and the neutral busbar, are formed with at least one of a bolted connection and a welded connection.

8. The load center of claim 1, wherein the plug-in neutral conductor is snap-mounted to the mounting rail and snap-mounted to the neutral busbar.

9. The load center of claim 1, wherein the plug-in neutral conductor terminating at one end with a snap-mounted coupling to the neutral busbar.

* * * * *